US006786188B1

(12) United States Patent
Kawamoto

(10) Patent No.: US 6,786,188 B1
(45) Date of Patent: Sep. 7, 2004

(54) DRY-SUMP LUBRICATION TYPE FOUR-STROKE CYCLE ENGINE

(75) Inventor: Yuichi Kawamoto, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/438,099

(22) Filed: May 15, 2003

(51) Int. Cl.[7] ..... F02F 1/00
(52) U.S. Cl. ..... 123/196 R; 123/196 S
(58) Field of Search ..... 123/196 R, 196 S; 184/11.3, 11.5

(56) References Cited

U.S. PATENT DOCUMENTS 5,063,895 A * 11/1991 Ampferer ..... 123/196 R
6,491,010 B2 * 12/2002 Kawamoto et al. ..... 123/90.27
6,637,399 B2 * 10/2003 Sato et al. ..... 123/196 R
6,705,271 B2 * 3/2004 Liu ..... 123/196 R

FOREIGN PATENT DOCUMENTS

JP A 61-215411 9/1986
JP A 6-288466 10/1994

* cited by examiner

*Primary Examiner*—Henry C. Yuen
*Assistant Examiner*—Jason Benton
(74) *Attorney, Agent, or Firm*—Oliff & Berridge, PLC

(57) ABSTRACT

A dry-sump lubrication type four-stroke cycle engine having a crankcase provided with a crankshaft chamber in its front part and a transmission chamber in its rear part, a generator chamber on one side of the crankcase in an axial direction of the crankshaft, and a clutch chamber on the other side of the crankcase. The crankshaft chamber and the transmission chamber are separated by a partition wall of a predetermined height to form an oil reservoir chamber in a lower part of the transmission chamber. An auxiliary oil reservoir chamber is formed in a lower part of the clutch chamber. A suction chamber is formed under a crankshaft chamber bottom wall defining a bottom of the crankshaft chamber so as to communicate with a suction port of a scavenging pump of the engine. The suction chamber opens into the crankshaft chamber through a first suction hole formed in the crankshaft chamber bottom wall and opens into the generator chamber through a second suction hole formed in a wall defining the bottom of the generator chamber. The scavenging pump pumps up oil directly from the suction chamber and discharges oil into the oil reservoir chamber.

9 Claims, 8 Drawing Sheets

DRY-SUMP LUBRICATION TYPE FOUR-STROKE CYCLE ENGINE

BACKGROUND OF THE INVENTION

1. Field of the Invention

The present invention relates to a dry-sump lubrication type four-stroke cycle engine suitable for a vehicle, such as a straddle type all-terrain four-wheel vehicle or a motorcycle, and, more specifically to improvements in an oil reserving and circulating system of the engine.

2. Description of the Related Art

A conventional dry-sump lubrication four-stroke cycle engine usually has an oil tank separated from a crank case of the engine, an oil feed pump and an oil return pump, i.e., a scavenging pump. The oil tank holds a predetermined quantity of an engine oil. The oil feed pump pumps up oil from the oil tank and feeds the oil by pressure to parts needing lubrication of the engine, and the scavenging pump pumps up used oil collected in the bottom of the crankcase or an oil pan and returns the used oil into the oil tank. This dry-sump lubrication system increases the weight, component parts and cost of the engine, and needs pipes for connecting the crankcase and the oil tank.

A dry-sump lubrication type four-stroke cycle engine previously proposed by the applicant of the present patent application in JP-A No. 288466/1994 is not provided with any external oil tank and has a transmission chamber having a lower part serving as an oil reservoir chamber. FIGS. 12 and 13 are side elevations respectively showing the left side surface of a right half-crankcase, and the right side surface of a left half-crankcase of the dry-sump lubrication type four-stroke cycle engine disclosed in JP-A No. 288466/1994.

Referring to FIG. 12, a partition wall 123 of a predetermined height is formed between a crankshaft chamber 121 and a transmission chamber 122 in a crankcase 120 to use a lower part of the transmission chamber 122 as an oil reservoir chamber 125. A triangular oil collecting chamber 126 extending rearward is formed in a lower rear part of the crankshaft chamber 121, a suction opening 127 is formed in a wall defining an axial end of the oil collecting chamber 126. A scavenging pump of the engine sucks oil dripped in the crankshaft chamber 121 and collected in the oil collecting chamber 126 through the suction opening 127 and discharges the oil into the transmission chamber 122 to keep the crankshaft chamber 121 in a dry state.

Referring to FIG. 13, a connecting hole 131 is formed in a part, in front of the oil collecting chamber 126, of the left half-crankcase to connect the bottom of the crankshaft chamber 121 and the bottom of a generator chamber (not shown) extending into the paper in FIG. 13 to let oil dripped into the generator chamber flow through the connecting hole 131 into the crankshaft chamber 121. Oil flowed into the crankshaft chamber 121 is sucked up together with oil collected in the oil collecting chamber 126 by the scavenging pump through the suction opening 127.

An engine disclosed in JP-A No. 215411/1986 has a transmission chamber having a lower part serving as an oil reservoir chamber. Although this engine is similar to that disclosed in JP-A No. 288466/1994 in forming a partition wall between a transmission chamber and a crankshaft chamber and using a lower part of the transmission chamber as an oil reservoir chamber, a generator chamber formed on one side of the crankshaft chamber and a clutch chamber formed on the other side of the crankshaft chamber are connected by a connecting passage extending under the crankshaft chamber, and the crankshaft chamber and the generator chamber are connected by a connecting hole. Oil dripped into the crankshaft chamber flows into the generator chamber, oil is contained in both the generator chamber and the clutch chamber at the same oil level, and then a scavenging pump of the engine pumps up the thus collected oil and discharges oil into the oil reservoir chamber.

In the engine disclosed in JP-A No. 288466/1994, which sucks oil from the triangular oil collecting chamber 126 formed in a lower rear part of the crankshaft chamber 121 so as to extend rearward, gases and oil are forced to flow together into the oil collecting chamber 126 by the rotation of crank arms of a crank shaft contained in the crankshaft chamber 121 and therefore, oil is unable to flow smoothly through the suction opening 127 formed in one side of the oil collecting chamber 126, which affects adversely to the suction efficiency of the scavenging pump.

Since oil dripped into the generator chamber flows into the crankshaft chamber 121 and oil is forced to flow together with oil collected in the crankshaft chamber 121 into the oil collecting chamber 126, the quantity of oil contained in the crankshaft chamber 121 increases temporarily before oil flows into the oil collecting chamber 126, which is undesirable in view of keeping the crankshaft chamber 121 of the dry-sump lubrication type engine in a dry state.

In the engine disclosed in UP-A No. 215411/1986, the generator chamber and the clutch chamber formed on the opposite sides of the crankshaft chamber communicate with each other by means of the connecting passage and hence oil remains always in the generator chamber and the clutch chamber. Consequently, a large quantity of oil flows from the generator chamber into the crankshaft chamber when the engine is tilted beyond a certain angle and hence it is possible that the crankshaft chamber cannot be maintained in a dry state.

SUMMARY OF THE INVENTION

The present invention has been made in view of the foregoing problems and it is therefore an object of the present invention to provide a compact dry-sump lubrication type four-stroke cycle engine provided with a lightweight lubricating system comprising a small number of component parts, being capable of efficiently using an oil pump, and having a large oil capacity.

According to one aspect of the present invention, a dry-sump lubrication type four-stroke cycle engine has a crankcase provided with a crankshaft chamber containing a crankshaft in its front part and a transmission chamber in its rear part, a generator chamber on one side of the crankcase in an axial direction of the crankshaft, and a clutch chamber on the other side of the crankcase; wherein the crankshaft chamber and the transmission chamber are separated by a partition wall of a predetermined height to form an oil reservoir chamber in a lower part of the transmission chamber, an auxiliary oil reservoir chamber is formed in a lower part of the clutch chamber so as to communicated with the oil reservoir chamber, a suction chamber is formed integrally with the crankcase under a crankshaft chamber bottom wall defining a bottom of the crankshaft chamber so as to communicate with a suction port of a scavenging pump of the engine, the suction chamber opens into the crankshaft chamber through a first suction hole formed in the crankshaft chamber bottom wall and opens into the generator chamber through a second suction hole formed in a wall defining a bottom of the generator chamber, and the scavenging pump pumps up oil from the suction chamber and discharges oil into the oil reservoir chamber or the auxiliary oil reservoir chamber.

According such a structure, the dry-sump lubrication type four-stroke cycle engine of the present invention is able to save external piping and mounting apace for an external oil tank, and further, is able to increase the quantity of oil that can be reserved in the crankcase without enlarging the crankcase.

Since the dead space under the wall defining the bottom of the crankshaft chamber is used as the suction chamber, the suction passage of the scavenging pump can be formed with a simple structure.

Since oil flowed from the crankshaft chamber into the suction chamber is sucked by the scavenging pump, the flow of oil into the scavenging pump is hardly affected and disturbed directly by the revolution of the crank shaft, oil can be smoothly sucked by the scavenging pump.

Since the generator chamber is connected directly to the suction chamber formed under the wall defining the crankshaft chamber by the second suction hole, suction of oil from the generator chamber is affected scarcely by pressure variation in the crankshaft chamber.

Preferably, the first suction hole formed in the crankshaft chamber bottom wall may have an elongate shape extending along an axis of a crankshaft and has a length substantially corresponding to an overall width, along the axis of the crankshaft, of crank arms of the crankshaft contained in the crankshaft chamber.

The elongate suction hole enables quick suction of oil from the crankshaft chamber.

Preferably, the scavenging pump may be disposed in the generator chamber.

Thus, oil collected in the generator chamber can be sucked through a short suction passage by the scavenging pump, which prevents the reduction of suction force that acts on oil.

Preferably, the scavenging pump may be disposed in the clutch chamber.

Thus, the scavenging pump is able to discharge oil into the clutch chamber, which simplifies discharge piping related with the scavenging pump.

Preferably, the clutch chamber and the transmission chamber may be connected by an overflow passage extending at a predetermined oil level in the oil reservoir chamber to enable oil to flow from the oil reservoir chamber to the auxiliary chamber, the clutch chamber and the suction chamber may be connected by a level limiting hole at a oil level below that of the overflow passage to enable oil to flow from the clutch chamber through the level limiting hole into the suction chamber so that oil level in the clutch chamber is maintained below that of an oil level in the transmission chamber.

Thus, even though a lower part of the clutch chamber is used as the auxiliary oil reservoir chamber, the clutch can be disposed in a lower position near the oil level, which enables forming the engine in a short height.

Preferably, respective bottoms of the clutch chamber and the transmission chamber may be connected by a connecting hole to maintain the oil level in the clutch chamber substantially equal to that in the transmission chamber.

Thus, an increased quantity of oil can be reserved in the crankcase.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

First Embodiment

[Vehicle Provided with Engine]

Figure 1:
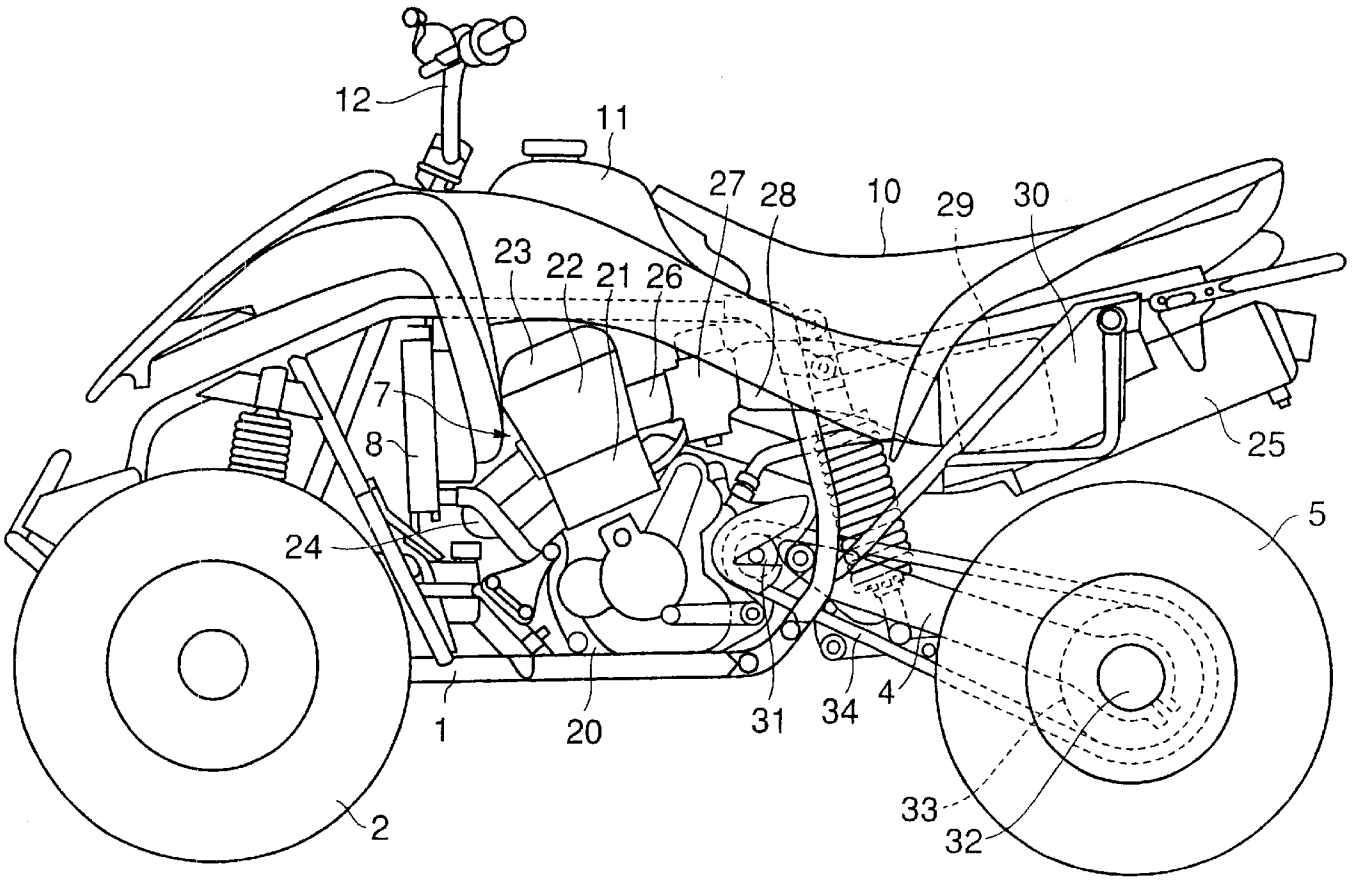
FIG. 1 is aside elevation of a straddle type all-terrain four-wheel vehicle provided with a dry-sump lubrication type four-stroke cycle engine in a preferred embodiment according to the present invention.

Referring to FIG. 1 showing a straddle type all-terrain four-wheel vehicle provided with a dry-sump lubrication type four-stroke cycle engine 7 (hereinafter referred to simply as "engine") in a first embodiment according to the present invention, right and left front wheels 2 are supported on a front part of a body frame 1 and right and left rear wheels 5 are supported on a swing arm 4 pivotally supported on a rear part of the main frame 1. A swing motion of the swing arm 4 is controlled by a shock absorber 3. The engine 7 and a radiator 8 are mounted on the body frame 1. A saddle-type seat 10, a fuel tank 11 and a handlebar 12 are arranged in an upper part of the body frame 1.

The engine 7 is built by stacking and fastening together a cylinder 21, a cylinder head 22 and a cylinder head cover 23 in that order on a crankcase 20. An exhaust pipe 24 is connected to an exhaust port formed in a front part of the cylinder head 22. The exhaust pipe 24 is bent to the right and is extended rearward. A muffler 25 is connected to the rear end of the exhaust pipe 24. An intake pipe 26 is connected to an intake port formed in a rear part of the cylinder head 21. A carburetor 27, an intake duct 28 and an air cleaner 30 provided with an air cleaner element 29 are connected to the intake pipe 26.

The vehicle is provided with a chain-drive mechanism including a drive sprocket 31 mounted on an output shaft of the engine 7, a driven sprocket 33 mounted on a rear axle 32, and a drive chain 34 extended between the drive sprocket 31 and the driven sprocket 33. The rear wheels 5 are driven through the chain-drive mechanism by the engine 7.

[Engine]

Figure 2:
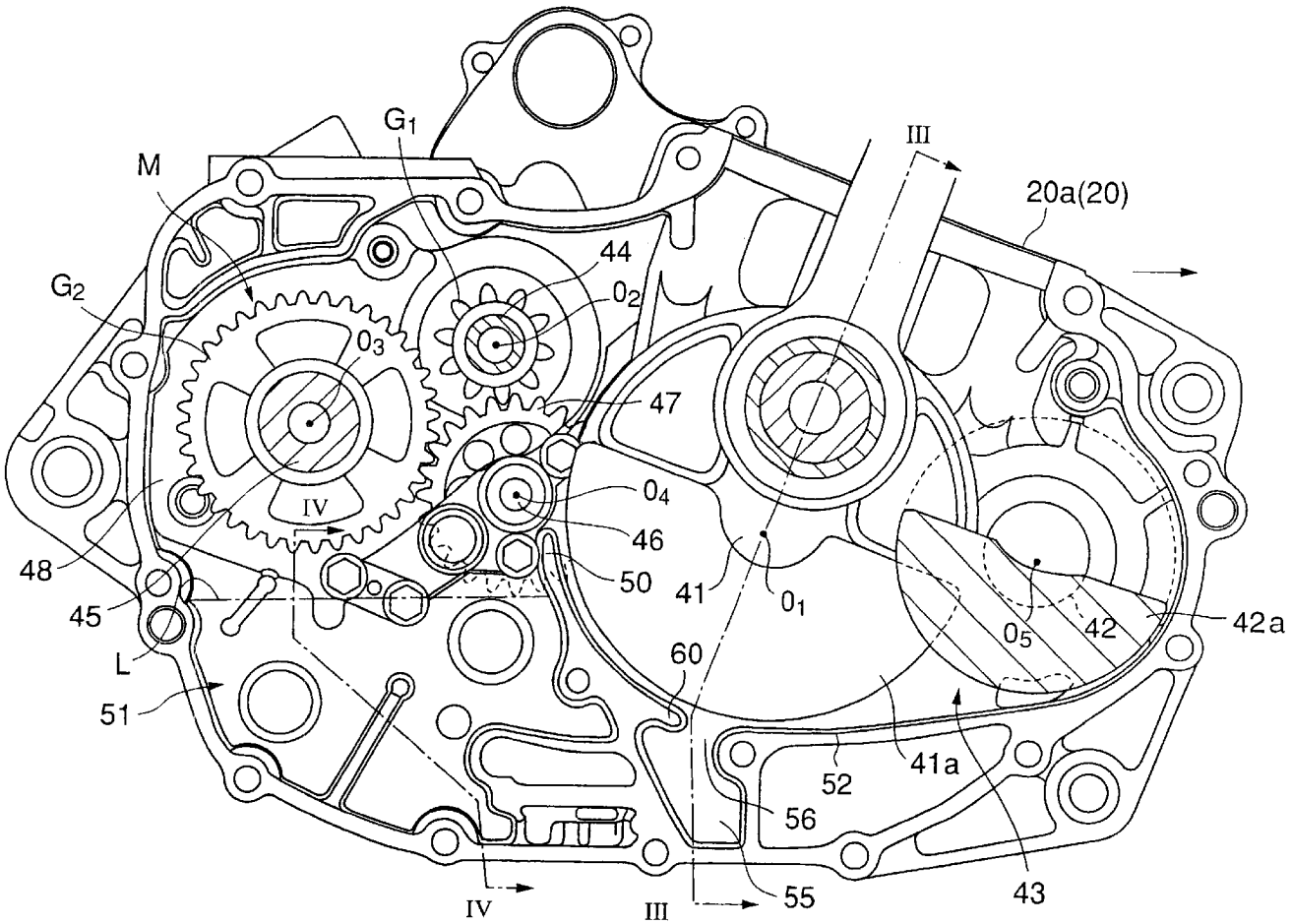
FIG. 2 is a sectional side view taken on a plane including a joint surface of right and left half-crankcases of the engine shown in FIG. 1, showing an inside of the left half-crankcase.

FIG. 2 is a sectional side view taken on plane including a joint surface of a right half-crankcase 20*b* and a left half-crankcase 20*a* forming the crankcase 20, showing an inside of the left half-crankcase 20*a*. As shown in FIG. 2, the crankcase 20 has a crankshaft chamber 43 in its front part and a transmission chamber 48 in its rear part. A crankshaft 41 including crank arms 41*a* and a balancer shaft 42 including a balance weight 42*a* are placed in the crankshaft chamber 43, and a transmission M is placed in the transmission chamber 48. The transmission M includes a transmission input shaft 44, a transmission output shaft 45, a reverse idle shaft 46, input gears $G_1$, output gears $G_2$ and a reverse idle gear 47. In FIG. 2, indicated at $O_1$ is the axis of the crankshaft 41, and at $O_2$ is the axis of the transmission input shaft 44, at $O_3$ is the axis of the transmission output shaft 45, at $O_4$ is the axis of the reverse idle shaft 46, and at $O_5$ is the axis of the balancer shaft 42.

A partition wall 50 formed integrally with the crankcase 20 separates the crankshaft chamber 43 and the transmission chamber 48. The partition wall 50 defines an oil reservoir chamber 51 isolated from the crankshaft chamber 43 in a lower part of the transmission chamber 48. An upper edge of the partition wall 50 is on the substantially the same level as the axis $O_1$ of the crankshaft 41. The partition wall 50 extends downward toward the front along a contour of the crank arms 41*a* including counterweights and is joined to a crankshaft chamber bottom wall 52. The crankshaft chamber bottom wall 52 extends forward via a position below the balancer shaft 42 and extends around the balancer weight 42*a* of the balancer shaft 42 to the upper end of the crankshaft chamber 43. The transmission gears $G_1$ and $G_2$ and the reverse idle gear 47 are arranged above an oil level $L_1$ in the oil reservoir chamber 51 so that the transmission gears $G_1$ and $G_2$ and the reverse idle gear 47 are immersed scarcely in oil contained in the oil reservoir chamber 51 to avoid the reduction of power transmission efficiency.

A suction chamber 55 is formed in the crankcase 20 under the crankshaft chamber bottom wall 52. The suction chamber 55 is slightly behind the axis $O_1$ of the crankshaft 41. The suction chamber 55 communicates with the crankshaft chamber 43 by means of a suction hole 56 formed in the crankshaft chamber bottom wall 52.

Figure 6:
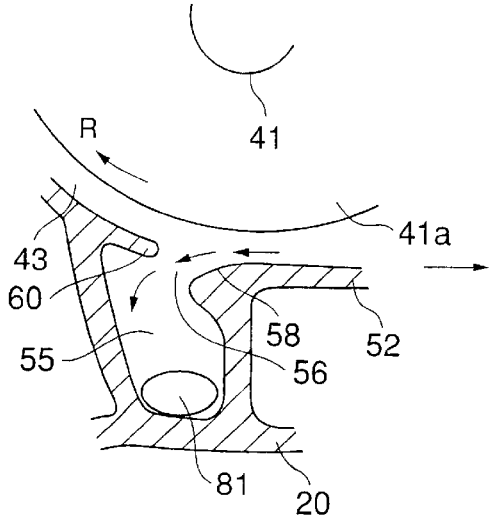
FIG. 6 is an enlarged longitudinal sectional view of a suction chamber shown in FIG. 2.

Referring to FIG. 6 showing the suction chamber 55 in an enlarged sectional view, an front edge part 58 sloping down rearward defines the front edge of the suction hole 56 formed in the crankshaft chamber bottom wall 52 to facilitate the flow of oil from the front edge into the suction chamber 55. A rear edge part 60 sloping down forward defines the rear edge of the suction hole 56 to trap oil flowed into the suction chamber 55. In other words, the rear edge part 60 separates the suction chamber 55 from the crankshaft chamber 43 and the rear edge part 60 is formed to cover the rear part of the suction chamber 55.

Figure 3:
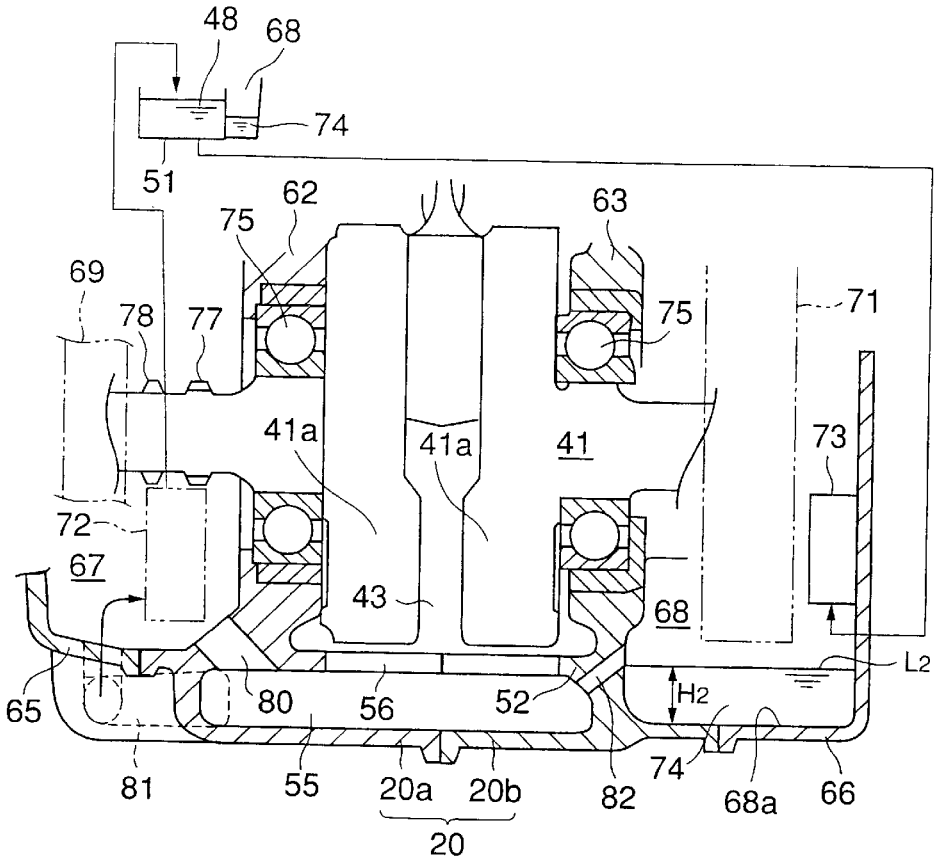
FIG. 3 is a sectional view taken on line III—III in FIG. 2.

Referring to FIG. 3 showing a sectional view taken on the line III—III in FIG. 2, the crankcase 20 is built by joining together the right half-crankcase 20*b* and the left half-crankcase 20*a*. A generator cover 65 and a clutch cover 66 are attached to the left end wall 62 and the right end wall 63 of the crankcase 20 to define a generator chamber 67 and a clutch chamber 68, respectively. A generator 69 and a scavenging pump 72 are placed in the generator chamber 67. A multiple-disk clutch 71 and a feed pump 73 are placed in the clutch chamber 68. Oil is reserved at a fixed level $L_2$ in an auxiliary oil reservoir chamber 74 formed in a lower part of the clutch chamber 68.

The crankshaft 41 is supported for rotation in bearings 75 on the left end wall 62 and the right end wall 63 of the crankcase 20. A left end part of the crankshaft 41 projecting into the generator chamber 67 is provided with a camshaft drive sprocket 77 and a scavenging pump drive sprocket 78. The rotor, which serves also as a flywheel, of the generator 69 is mounted on the left end part of the crankshaft 41. A right end part of the crankshaft 41 projecting into the clutch chamber is provided with a crankshaft gear, not shown, and a pump drive gear, not shown. The crankshaft gear is meshed with a clutch gear, not shown, and the pump drive gear is meshed with the gear of the feed pump 73.

The suction chamber 55 formed under the crankshaft chamber bottom wall 52 extends between the left end wall 62 and the right end wall 63 of the crankcase 20. The suction hole 56 extends laterally and has a width approximately equal to the width of the crank arms 41*a*.

The suction chamber 55 communicates with the generator chamber 67 by means of a suction hole 80 extending obliquely upward from a left end part of the suction chamber 55 to a lower right end part of the generator chamber 67. A suction passage 81 extending to a suction port of the scavenging pump 72 is formed in a left end part of the suction chamber 55. A suction force of the scavenging pump 72 acts directly on the suction chamber 55. The discharge port of the scavenging pump 72 is connected to the oil reservoir chamber 51 of the transmission chamber 48. The suction chamber 55 communicates with the clutch chamber 68 by means of an oil level limiting hole 82 extending obliquely upward to the right from a right end part thereof and opening into the clutch chamber 68 at a height $H_2$from the bottom 68*a* of the clutch chamber 68. Excess oil flows from the clutch chamber 68 through the oil level limiting hole 82 into the suction chamber 55 to maintain the oil level $L_2$ of oil in the clutch chamber 68 at a predetermined height not higher than the height $H_2$.

Figure 4:
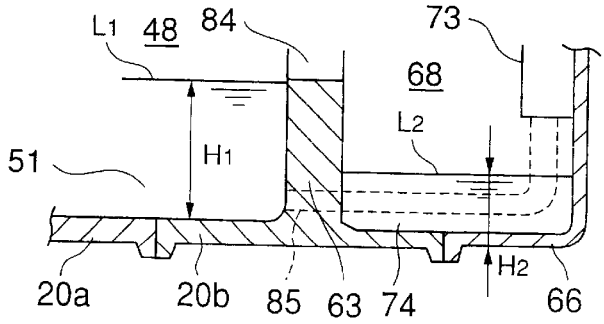
FIG. 4 is a sectional view taken on line IV—IV in FIG. 2.

Referring to FIG. 4 showing a sectional view taken on the line IV—IV in FIG. 2, an overflow hole 84 is formed in the right end wall 63 of the crankcase 20 separating the transmission chamber 48 and the clutch chamber 68. The overflow hole 84 is at a height greater than the height $H_2$ of the oil level limiting hole 82. Excess oil flows from the oil reservoir chamber 51 through the overflow hole 84 into the clutch chamber 68 to maintain oil contained in the oil reservoir chamber 51 at a predetermined oil level $L_1$ and to supply oil to the auxiliary oil reservoir chamber 74 of the clutch chamber 68. The feed pump 73 placed in the clutch chamber 68 has a suction port communicates with the bottom of the oil reservoir chamber 51 by means of a passage 85, and a discharge port connected to parts needing lubrication of the engine including the transmission M and camshafts and the associated parts.

Figure 5:
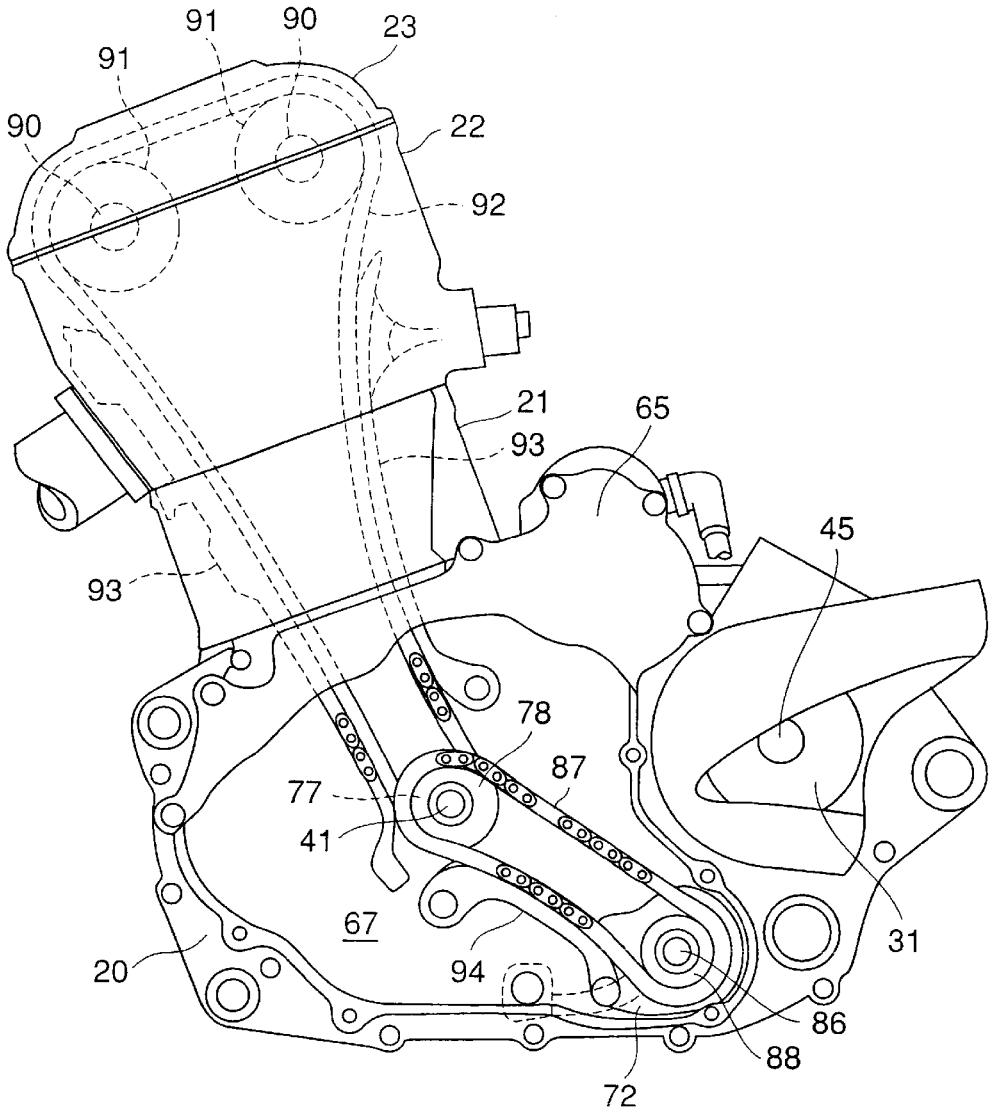
FIG. 5 is a side elevation of the engine shown in FIG. 1, showing the left side of the engine with a generator cover partly cutaway.

Referring to FIG. 5 showing the engine shown in FIG. 1 in an enlarged view taken from the left side, in which the generator cover 65 is partly cutaway, the pump shaft 86 of the scavenging pump 72 placed in the generator chamber 67 is interlocked with the crankshaft 41 by the pump drive sprocket 78 of the crankshaft 41, a sprocket 88 on the pump shaft 86 and a pump drive chain 87. A pair of camshafts 90 supported on the cylinder head 22 are interlocked with the crankshaft 41 by camshaft sprockets 91, a camshaft drive chain 92 and the camshaft drive sprocket 77 of the crankshaft 41. The camshaft drive chain 92 is extended from the generator chamber 67 through a camshaft drive chain tunnel formed in the left side walls of the cylinder 21 and the cylinder head 22 to the camshaft sprockets 91. Chain guides 94 and 93 guide the chains 87 and 92, respectively.

Referring again to FIG. 3, oil pumped by the feed pump 73 is supplied by pressure to parts needing lubrication including the crankshaft 4 1and the related parts, camshafts 90 and the related parts, and the transmission M and the related parts for lubrication and cooling. Oil used for lubricating the crankshaft 41 and the related parts drips into the crankshaft chamber 43, oil used for lubricating camshafts 90 and the related parts drips through the camshaft drive chain tunnel into the generator chamber 67, and oil used for lubricating the transmission M and the related parts drips directly into the oil reservoir chamber 51 of the transmission chamber 48. The oil collected in the bottom of the generator chamber 67 is sucked together with gases through the suction hole 80 into the suction chamber 55 by the agency of the suction of the scavenging pump 72. The oil collected in the bottom of the crankshaft chamber 43 is sucked through the suction hole 56 into the suction chamber 55 by the agency of the suction of the scavenging pump 72 and the rotation of the crank arms 41*a*. The scavenging pump 72 sucks oil thus sucked into the suction chamber 55 through the suction passage 81 and returns the same into the oil reservoir chamber 51 of the transmission chamber 48.

Referring to FIG. 4, when the level of oil in the transmission chamber 48 rises beyond the predetermined height $H_1$, excess oil flows through the overflow hole 84 into the auxiliary oil reservoir chamber 74 of the clutch chamber 68. If the oil level of oil in the auxiliary oil reservoir chamber 74 rises beyond the height $H_2$ (FIG. 3), excess oil flows through the level limiting hole 82 into the suction chamber 55.

Referring to FIG. 6, oil dripped onto the crankshaft chamber bottom wall 52 is sucked into the suction chamber 55 by the agency of the suction of the scavenging pump 72 and the rotation of the crank arms 41*a* as described above. The oil dripped onto the crankshaft chamber 55 flows smoothly along the front edge part 58 into the suction chamber 55 and the rear edge part 60 traps oil flowed into the suction chamber 55. Thus, oil can be collected in the suction chamber 55 efficiently and can be sucked up from the suction chamber 55 through the suction passage 81.

Second Embodiment

Figure 7:
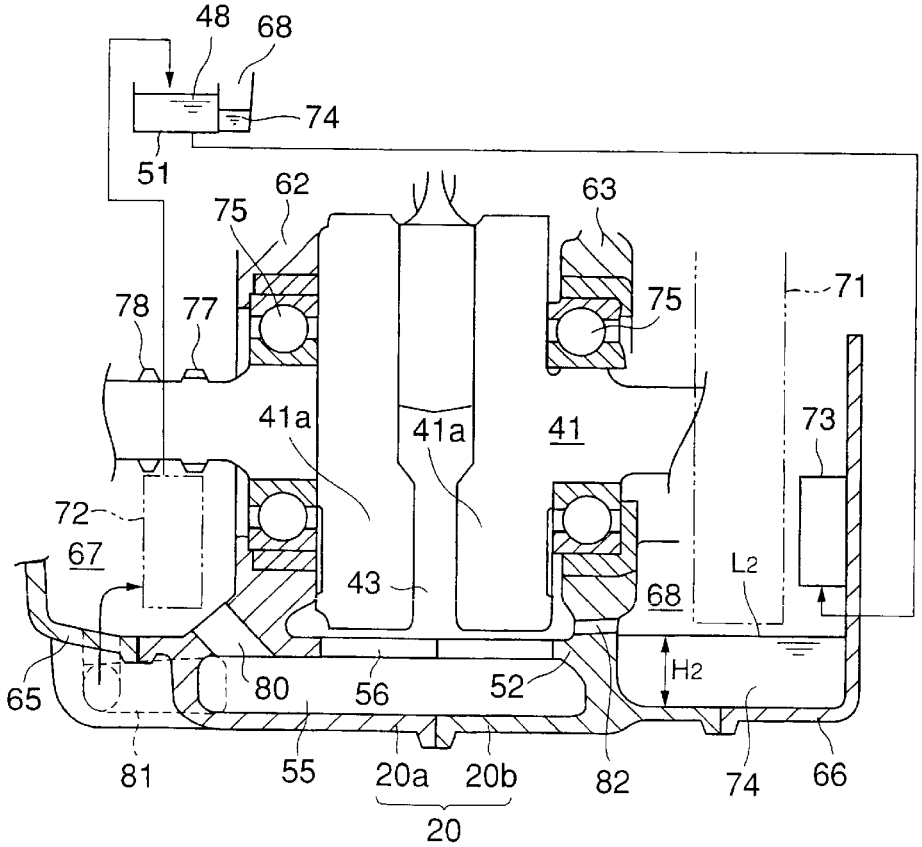
FIG. 7 is a sectional view of a part, corresponding to the part shown in FIG. 3, of a dry-sump lubrication type four-stroke cycle engine in a second embodiment according to the present invention.
Figure 8:
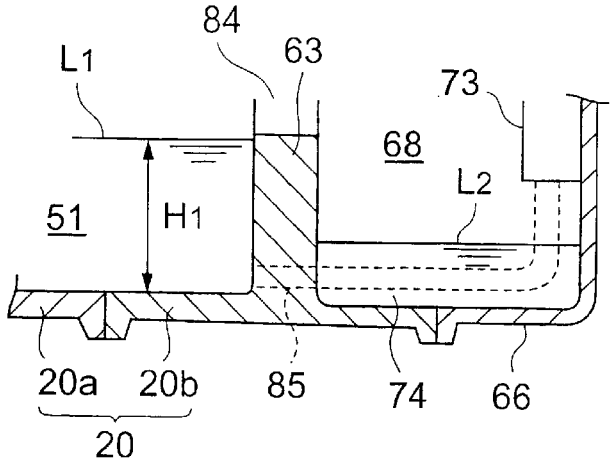
FIG. 8 is a sectional view of a part, corresponding to the part shown in FIG. 4, of the dry-sump lubrication type four-stroke cycle engine in the second embodiment.

FIGS. 7 and 8 show parts of a dry-sump lubrication type four-stroke cycle engine in a second embodiment according to the present invention, respectively corresponding to those shown in FIGS. 3 and 4, in which parts like or corresponding to those shown in FIGS. 3 and 4 are denoted by the same reference characters and the detailed explanations are omitted. Excepting an oil level limiting hole 82, the dry-sump lubrication type four-stroke cycle engine in the second embodiment is identical with that shown in FIGS. 1 to 6. Referring to FIG. 7, the oil level limiting hole 82 formed in the right end wall 63 of a crankcase 20 so as to extend from a clutch chamber 68 to a crankshaft chamber 43 opens into the bottom of the crankshaft chamber 43 defined by a crankshaft chamber bottom wall 52. A suction hole 56 formed in the crankshaft chamber bottom wall 52 opens into a suction chamber 55.

Third Embodiment

Figure 9:
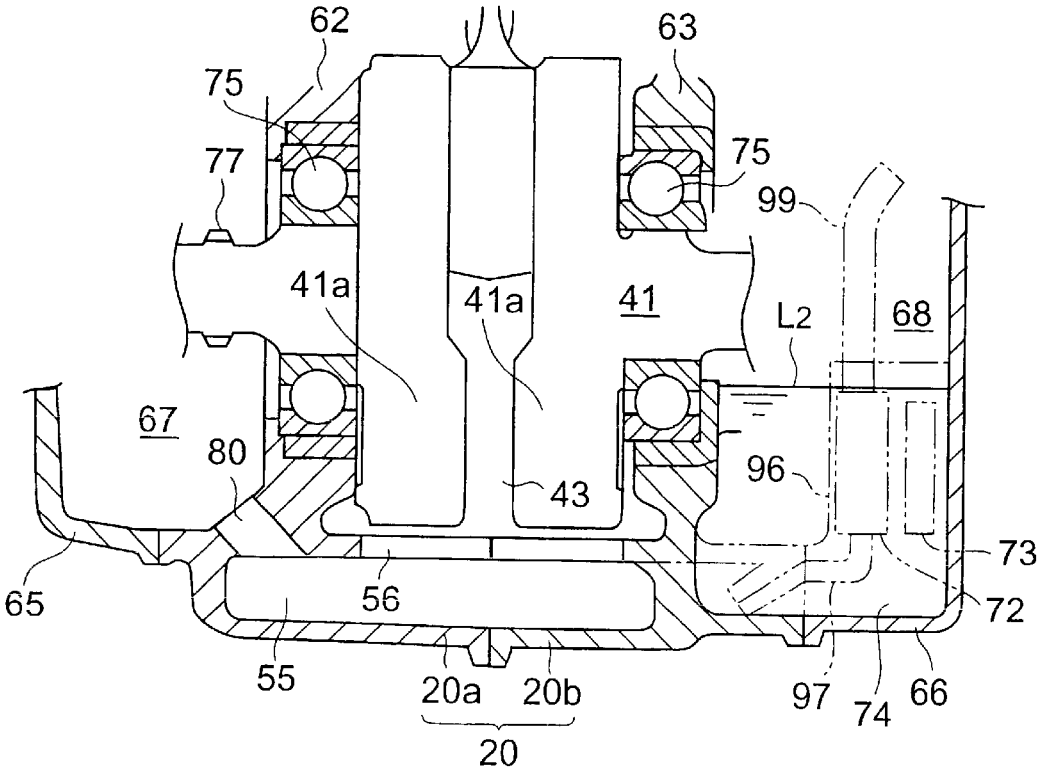
FIG. 9 is a sectional view of a part, corresponding to the part shown in FIG. 3, of a dry-sump lubrication type four-stroke cycle engine in a third embodiment according to the present invention.
Figure 10:
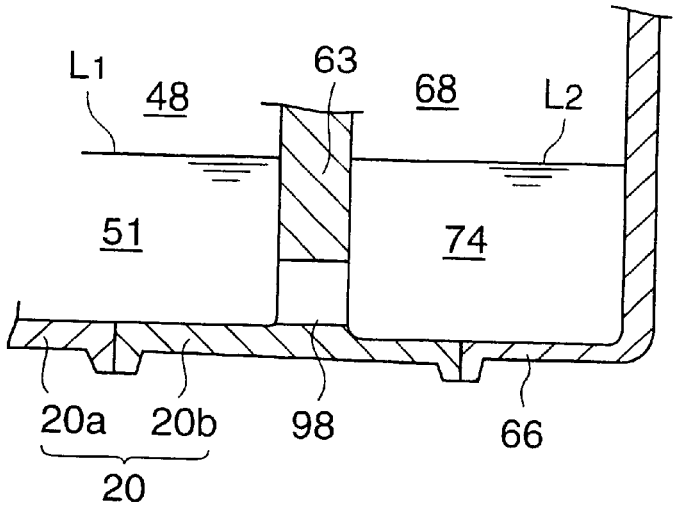
FIG. 10 is a sectional view of a part, corresponding to the part shown in FIG. 4, of the dry-sump lubrication type four-stroke cycle engine in the third embodiment.

FIGS. 9 and 10 show parts of a dry-sump lubrication type four-stroke cycle engine in a third embodiment according to the present invention, respectively corresponding to those shown in FIGS. 3 and 4, in which parts like or corresponding to those shown in FIGS. 3 and 4 are denoted by the same reference characters and the detailed explanations are omitted. Referring to FIG. 9, a scavenging pump 72 and a feed pump 73 are placed in a clutch chamber 68. A suction port of the scavenging pump 72 is connected by a suction passage 97 formed in a pump housing 96 to a right end part of a suction chamber 55. A discharge pipe 99 connected to a discharge port of the scavenging pump 72 is extended into an atmospheric space in the clutch chamber 68 to discharge oil into the atmospheric space. The right end wall 63 of a crankcase 20 is not provided with any oil level limiting hole. As shown in FIG. 10, the respective bottoms of an auxiliary oil reservoir chamber 74 formed in the clutch chamber 68 and an oil reservoir chamber 51 formed in a transmission chamber 48 are connected by a connecting hole 98 to maintain oil in the auxiliary oil reservoir chamber 74 and the oil reservoir chamber 51 at the same oil level $L_1$. The dry-sump lubrication type four-stroke cycle engine in the third embodiment is the same in other respects as that shown in FIGS. 1 to 6.

Modifications

Figure 11:
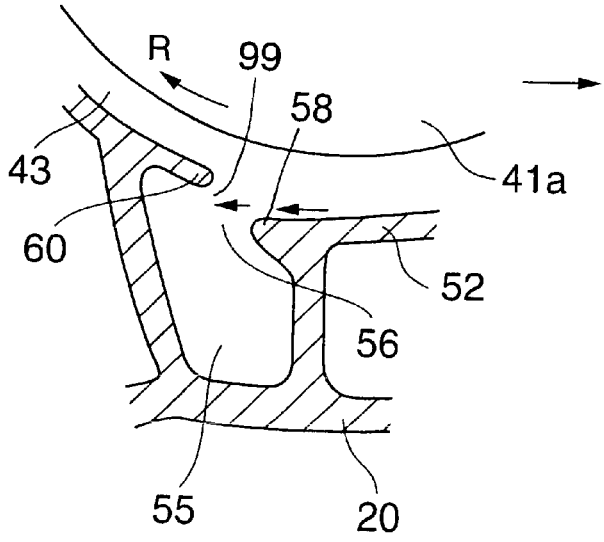
FIG. 11 is an enlarged sectional view of a suction chamber in a modification according to the present invention.
Figure 12:
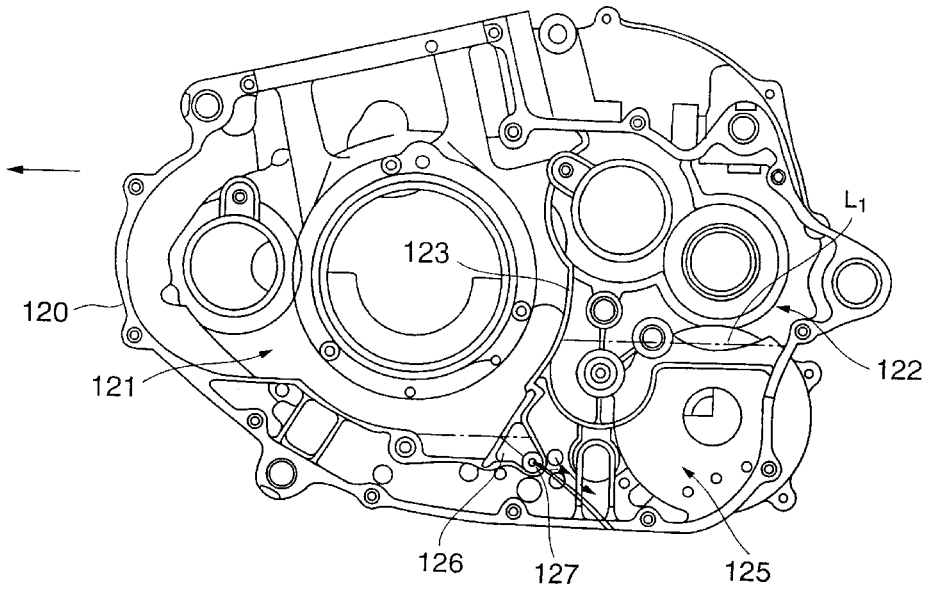
FIG. 12 is a side elevation of a right half-crankcase of a conventional dry-sump lubrication type four-stroke cycle engine, showing the left side surface.
Figure 13:
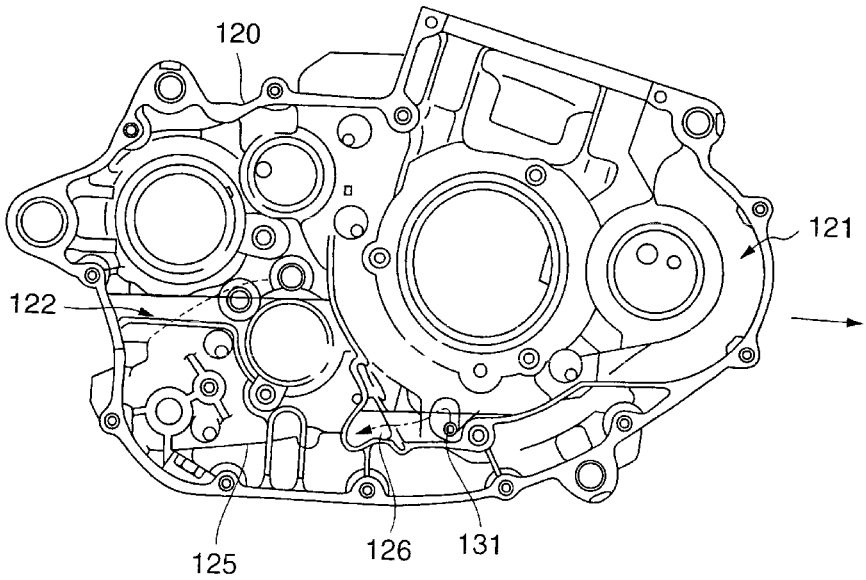
FIG. 13 is a side elevation of a left half-crankcase of the conventional dry-sump lubrication type four-stroke cycle engine, showing the left side surface.

FIG. 11 shows a suction hole 56 in a modification formed in the crankshaft chamber bottom wall 52. Parts like or corresponding to those shown in FIG. 6 are denoted by the same reference characters and the detailed explanations are omitted. A part defining a front edge part 58 of the suction hole 56 of the crankshaft chamber bottom wall 52 is at a level lower than that of a part forming a rear edge part 60 of the suction hole 56 of the crankshaft chamber bottom wall 52. In other words, the front edge part 58 is positioned outer than the rear edge part 60 in the radial direction of the crankshaft 41 so that a step 99 is formed between the front edge part 58 and the rear edge part 60. This suction hole 56 improves oil collecting efficiency.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A dry-sump lubrication type four-stroke cycle engine having a crankcase provided with a crankshaft chamber containing a crankshaft in its front part and a transmission chamber in its rear part, a generator chamber on one side of the crankcase in an axial direction of the crankshaft, and a clutch chamber on the other side of the crankcase;

wherein the crankshaft chamber and the transmission chamber are separated by a partition wall of a predetermined height to form an oil reservoir chamber in a lower part of the transmission chamber, an auxiliary oil reservoir chamber is formed in a lower part of the clutch chamber so as to communicated with the oil reservoir chamber, a suction chamber is formed integrally with the crankcase under a crankshaft chamber bottom wall defining a bottom of the crankshaft chamber so as to communicate with a suction port of a scavenging pump of the engine, the suction chamber opens into the crankshaft chamber through a first suction hole formed in the crankshaft chamber bottom wall and opens into the generator chamber through a second suction hole formed in a wall defining a bottom of the generator chamber, and the scavenging pump pumps up oil from the suction chamber and discharges oil into the oil reservoir chamber or the auxiliary oil reservoir chamber.

2. The dry-sump lubrication type four-stroke cycle engine according to claim 1, wherein the first suction hole formed in the crankshaft chamber bottom wall has an elongate shape extending along an axis of a crankshaft and has a length substantially corresponding to an overall width, along the axis of the crankshaft, of crank arms of the crankshaft contained in the crank chamber.

3. The dry-sump lubrication type four-stroke cycle engine according to claim 2, wherein a front edge part sloping down rearward defines a front edge of the first suction hole formed in the crankshaft chamber bottom wall to facilitate the flow of oil from the front edge part into the suction chamber.

4. The dry-sump lubrication type four-stroke cycle engine according to claim 3, wherein an rear edge part sloping down forward defines a rear edge of the first suction hole, and the rear edge part separates the suction chamber from the crankshaft chamber to cover a rear part of the suction chamber.

5. The dry-sump lubrication type four-stroke cycle engine according to claim 2, wherein a front edge part defines a front edge of the first suction hole formed in the crankshaft chamber bottom wall to facilitate the flow of oil from the front edge part into the suction chamber, a rear edge part defines a rear edge of the first suction hole, and the rear edge part separates the suction chamber from the crankshaft chamber to cover a rear part of the suction chamber, and the front edge part is positioned outer than the rear edge part in a radial direction of the crankshaft so that a step is formed between the front edge part and the rear edge part.

6. The dry-sump lubrication type four-stroke cycle engine according to claim 1, wherein the scavenging pump is disposed in the generator chamber.

7. The dry-sump lubrication type four-stroke cycle engine according to claim 1, wherein the scavenging pump is disposed in the clutch chamber.

8. The dry-sump lubrication type four-stroke cycle engine according to claim 1, wherein the clutch chamber and the transmission chamber are connected by an overflow passage extending at a predetermined oil level in the oil reservoir chamber to enable oil to flow from the oil reservoir chamber to the auxiliary chamber, the clutch chamber and the suction chamber are connected by a level limiting hole at a oil level below that of the overflow passage to enable oil to flow from the clutch chamber through the level limiting hole into the suction chamber so that oil level in the clutch chamber is maintained below that of an oil level in the transmission chamber.

9. The dry-sump lubrication type four-stroke cycle engine according to claim 1, wherein respective bottoms of the clutch chamber and the transmission chamber are connected by a connecting hole to maintain an oil level in the clutch chamber substantially equal to that in the transmission chamber.

* * * * *